United States Patent [19]

Kendrick

[11] Patent Number: 4,653,670

[45] Date of Patent: Mar. 31, 1987

[54] TWO-PIECE WINDING KEY FOR COLLAPSIBLE TUBES

[76] Inventor: James D. Kendrick, 59 Palm La., Novato, Calif. 94947

[21] Appl. No.: 866,793

[22] Filed: May 23, 1986

[51] Int. Cl.[4] ..... B65D 35/32

[52] U.S. Cl. ..... 222/99; 132/41 R

[58] Field of Search ..... 222/97–99; 132/41 R, 41 A; 24/489

[56] References Cited

U.S. PATENT DOCUMENTS

| | | | |
|---|---|---|---|
| 1,326,893 | 12/1919 | Tresenberg | 132/41 R |
| 1,941,631 | 1/1934 | Socoloff . | |
| 2,089,499 | 8/1937 | McFadden | 132/41 |
| 2,903,162 | 9/1959 | Regan | 222/99 |

FOREIGN PATENT DOCUMENTS

| | | | |
|---|---|---|---|
| 78392 | 11/1894 | Fed. Rep. of Germany . | |
| 1037849 | 9/1953 | France . | |
| 701423 | 12/1953 | United Kingdom | 222/99 |

*Primary Examiner*—H. Grant Skaggs

*Attorney, Agent, or Firm*—Thomas Schneck

[57] ABSTRACT

A two-piece winding key for folding collapsible-wall tubes and similar containers having an elongated blade with a lengthwise slot, a U-shaped clip and a pivot made up of elements integrally molded with the blade and the clip. The pivot comprises a rod terminating in a head, a first cylinder terminating in a retainer, each of which is opposed to each other on opposite arms of the clip, and a second cylinder on an end of the blade. The second cylinder fits over the first cylinder, and the rod snaps into the interior of the first cylinder to form a smoothly operating and durable pivot. The first cylinder may also have an annular boss on its outside surface for a more snug fit with the second cylinder. The slot in the blade may be provided with teeth for engaging an end of a collapsible tube without slippage. The tube is folded up by rotating the blade about its lengthwise axis, using the clip as a handle. The clip pivots so that it surrounds the blade in a closed position to prevent the tube from unfolding.

6 Claims, 8 Drawing Figures

TWO-PIECE WINDING KEY FOR COLLAPSIBLE TUBES

TECHNICAL FIELD

The invention relates to devices for winding collapsible wall containers, such as toothpaste tubes and the like.

BACKGROUND ART

In U.S. Pat. No. 2,903,162, Regan discloses a winding key for collapsible wall containers. These plastic or metal containers are commonly used for dispensing fluid and semifluid materials, such as toothpaste, shampoo, glue, lotions, medicines and cake frosting. Winding keys are desirable because they reduce waste of the tube contents, indicate the degree of fill in a tube and provide a neater tube appearance.

The winding key of Regan comprises a blank which has been punched or cut from a metal sheet and bent to have projecting longitudinal flanges. The flanges form therebetween a longitudinally-extending slot adapted to receive the flat tube end. At one end of the key, a handle is formed for manually rotating the key about its longitudinal axis, and thus winding the lower end of the tube. Pivotally connected to the key is a rigid retaining bar of a U-shaped configuration and having a pair of parallel legs joined at their extremities furthermost from the pivotal connection by a transverse portion. The extremities of the legs closest to the pivotal connection are bent inwardly and extend through oppositely aligned openings in the key. The retaining bar is thus pivotally connected to the body of the key by the cooperation of the inwardly directed extremities with the oppositely aligned openings of the key. A flange of the key is bent upwardly to abut the ends of the longitudinal flanges, and has a tongue adapted to receive and positively engage the transverse portion of the retaining bar when the bar is in its locking position. The retaining bar will then engage the container wall to oppose the restoring force inherent in the tube material which tends to cause unwinding.

Devices of the type described are quite useful, but have not found widespread acceptance because the cost of the winding key is significant compared to other manufacturing costs, such as the cost of the tube and its filling.

An object of the invention is to produce a winding key for collapsible tubes having simplified construction, which is durable and easy to use.

DISCLOSURE OF THE INVENTION

The above object has been achieved with a winding key featuring only two molded plastic pieces. A novel pivot construction includes elements integral with the two pieces.

One piece is an elongated, flat blade having a lengthwise slot formed therein for engaging an end of a collapsible tube. The slot may have a plurality of teeth for gripping the tube. A first cylinder formed at one end of the blade is one of the pivot elements.

The other of the two molded pieces is a U-shaped, unitary clip with first and second generally parallel, flat arms integrally united at a bend at one end of the arms. A second cylinder and a rod extend toward each other from the ends of the two arms furthest from the bend. The second cylinder and the rod are the other coaxial pivot elements. The second cylinder may have an annular boss around its outer surface for a tighter fit with the first cylinder.

The complete pivot is formed by fitting the first cylinder around the second cylinder, and then snapping the second cylinder and the rod together. The diameters of the cylinders and the rod are made so that the winding key is easy to assemble and so that the pivot is secure and durable. Preferably, the rod terminates in a head of increased rod diameter, and the second cylinder terminates in an annular retainer, integrally formed on the second cylinder.

The winding key of the present invention has a simpler molded construction compared to previous winding key devices. The pivot construction makes the device easy to construct, or to take apart if desired yet is sturdy and durable. Pivot elements which have an annular boss, a head on the end of the rod, and an annular retainer provide a tighter yet smoothly operating fit compared to pivot elements lacking these features. In an open position, turning the blade about a longitudinal axis winds the collapsible tube. The clip may be used as a handle in this folding operation. In a closed position, the clip prevents the tube from unwinding. With only two members, including the pivot, the construction of the present invention will encourage more prominent use of winding keys for collapsible wall tubes.

BEST MODE OF CARRYING OUT THE INVENTION

Figure 1:
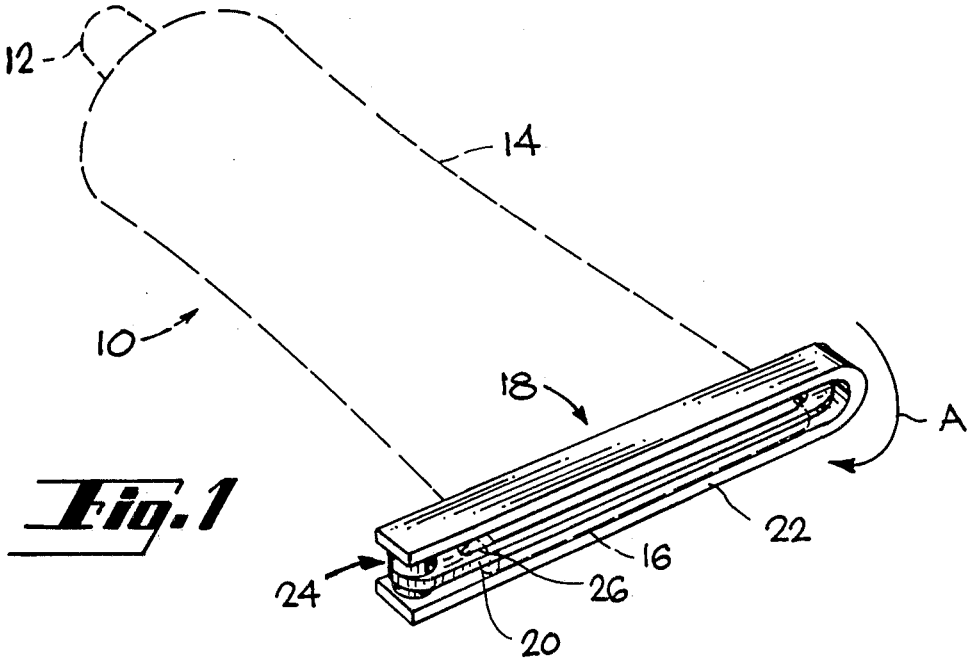
FIG. 1 is a perspective view of a tube folding article of the present invention engaging a collapsible tube.

With reference to FIG. 1, a tube 10 has a removable cap or knob 12 provided over a discharge opening at one end thereof. The tube 10 is a collapsible wall-type container, typically made of a plastic or metal material, such as polyethylene, and is typically used for dispensing fluid and semifluid materials, such as toothpaste, shampoo, glue, lotions, medicines and cake frostings. Materials are dispensed from the tube 10 by removing knob 12 from the tube's discharge opening and squeezing the tube wall 14. Knob 12 is usually replaced on the tube's opening when the tube 10 is not in use. The bottom end 16 of the tube distal to knob 12 is typically pressed flat and sealed, but this is not essential when tube 10 is used with the present invention.

A winding key 18 is seen in FIG. 1 engaging the bottom end 16 of tube 10. Winding key 18 comprises an elongated blade 20, a U-shaped clip 22 and a pivot 24. Winding key 18 is preferably made from any tough material which may be injection molded. Typical materials include nylon, Lexan, and ABS, the latter two names being trademarks for tough polymers. The blade 20 and clip 22 are molded so that elements of pivot 24 are integral with these two pieces 20 and 22.

Figure 2:
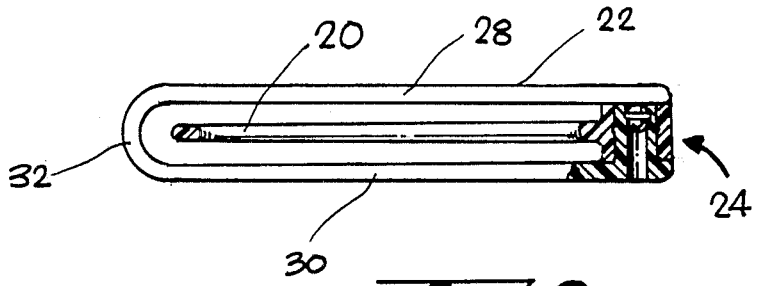
FIG. 2 is a side view of the tube folding article of FIG. 1.
Figure 3:
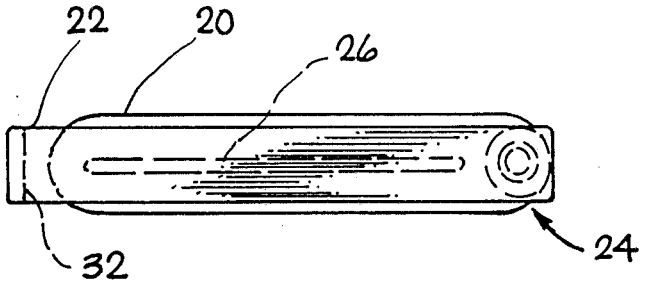
FIG. 3 is a top view of the tube folding article of FIG. 1 in a closed position.
Figure 4:
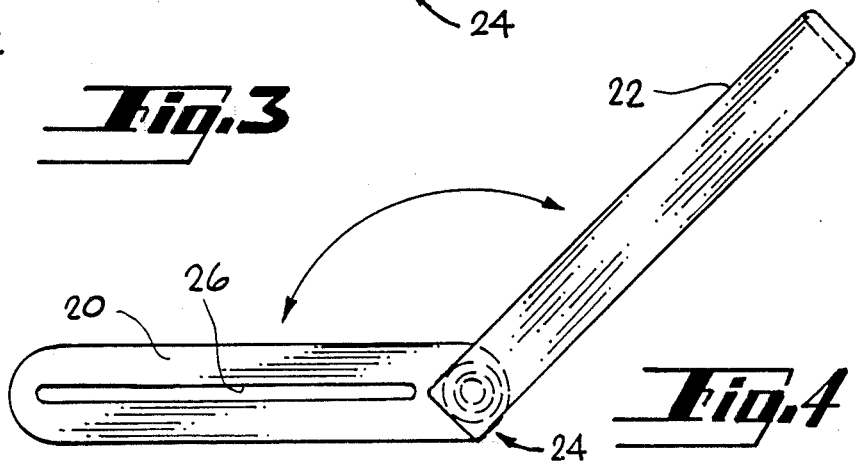
FIG. 4 is a top view of the tube folding article of FIG. 1 in an open position.

The relationship between blade 20, clip 22 and pivot 24 may be seen more clearly with reference to FIGS. 2, 3 and 4. Clip 22 is U-shaped, having a pair of flat arms 28 and 30 integrally joined at one end by a bend 32 in the clip. When tube folding article 18 is completely assembled, flat arms 28 and 30 are approximately parallel to one another. The flat blade 20 is also parallel to arms 28 and 30 so that the arms and blade are all parallel to each other. In a folded configuration, the winding key of the present invention resembles a pocket knife, with the parallel arms resembling a blade receiving handle, the blade herein resembling a knife blade and a pivot joining the blade to the parallel arms at one end of the arms.

Blade 20 has a length which is shorter than the length of arms 28 and 30 so as to be positioned between arms 28 and 30 in a closed position, as seen in FIGS. 2 and 3. Typically blade 20 is about 3.182 inches (80.82 mm) long measured from the axis of the pivot, while clip 21 is about 3.375 inches (85.72 mm) long. Blade 20 is movable relative to clip 22 about pivot 24 to an open position, as seen in FIG. 4. Pivot 24 connects blade 20 and clip 22 together at an end opposite from the end with bend 32. Elements of pivot 24 are integrally molded with arms 28 and 30 of clip 22 as well as with blade 20.

Blade 20 has a lengthwise slot 26 formed therein for engaging bottom end 16 of tube 10, as seen in FIG. 1. Slot 26 is typically about 2.5 inches (63.5 mm) long. In operation, tube 10 is folded with tube folding article 18 in an open position by turning blade 20 about a lengthwise axis in the direction A shown in FIG. 1. The tube 10 can be unfolded by turning blade 20 in the opposite direction. Clip 22 can be used as a handle for turning blade 20 relative to tube 10. When the tube has been folded the desired amount, clip 22 is moved about pivot 24 relative to blade 20 and tube 10 to the closed position seen in FIG. 1. In the closed position, clip 22 prevents tube 10 from unfolding by engaging the tube wall 14 so as to oppose any restoring force inherent in the tube material which tends to cause unfolding.

Figure 5:
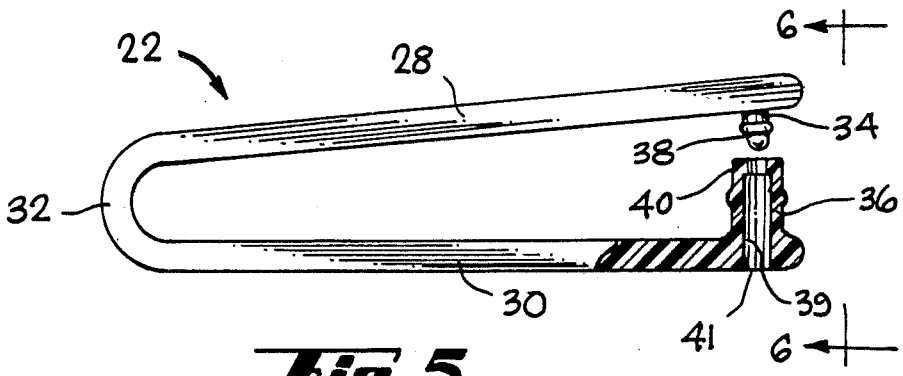
FIG. 5 is a partially cutaway side view of a clip, part of the tube folding article of FIG. 1.
Figure 6:
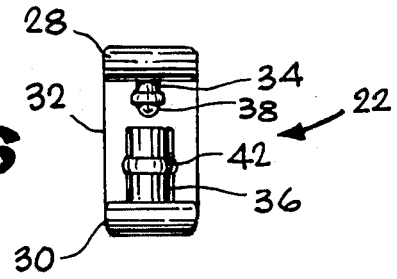
FIG. 6 is a front view of the clip of FIG. 5.

With reference to FIGS. 5 and 6, clip 22 has a first arm 28 and a second arm 30 integrally united at one end by a transverse bend 32. As mentioned above, when clip 22 is connected to a blade to form a tube folding article, the arms 28 and 30 are approximately parallel. When the clip is not connected to a blade, such as when clip 22 is first molded, the arms 28 and 30 are oriented about five degrees away from parallel relative to one another with the arms 28 and 30 being closest to one another near bend 32.

Near the end of first arm 28 furthest from bend 32, a rod 34, the first of three pivot elements, is integrally molded to first arm 28. Likewise, near the end of second arm 30 furthest from bend 32, a hollow post or first cylinder 36, another of the pivot elements, is integrally molded to second arm 30. Rod 34 extends from first arm 28 toward second arm 30 and terminates in a head 38. Head 38 is generally conical in shape for easier insertion into first cylinder 36. First cylinder 36 extends from second arm 30 toward first arm 28 and terminates in a retainer 40 integrally formed on first cylinder 36. First cylinder 36 has an annular boss 42 around its outside surface, the purpose of which will be disclosed further below with reference to FIGS. 7 and 8.

The dimensions of the rod 34 and first cylinder 36 in FIGS. 5 and 6 are such as to permit insertion of rod 34 into cylinder 36 and to securely lock these pivot elements into place. Thus rod 34 has a diameter, typically about 0.125 inches (3.18 mm), which equals or is slightly less than the interior diameter of retainer 40. Head 38 has a maximum diameter, typically about 0.138 inches (3.51 mm), which is slightly less than the interior diameter of first cylinder 36, typically about 0.142 inches (4.61 mm). Although, head 38 has a maximum diameter which exceeds the interior diameter of retainer 40, typically by about 0.013 inches (0.33 mm), the molded clip material is tough, but resilient enough to allow head 38 to penetrate the interior of cylinder 36 past retainer 40. This same difference also causes rod 34 and first cylinder 36 to securely lock together by tight frictional engagement once head 38 is past retainer 40. The interior surface 39 of first cylinder 36 and retainer 40 can be formed with a mold having a pin whose surface matches that of interior surface 41. Thus, interior surface 39 extends clear through second arm 30 to an opening 41 on the outside of second arm 30.

Figure 7:
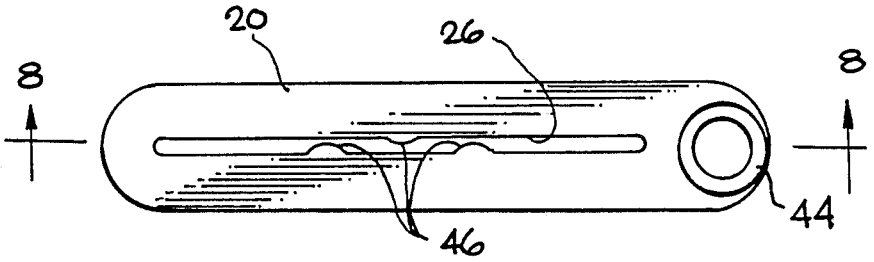
FIG. 7 is a top view of a blade, party of the tube folding article of FIG. 1.
Figure 8:
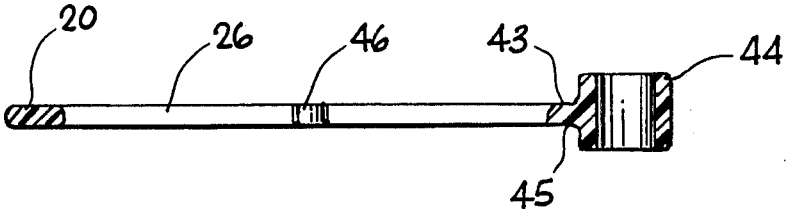
FIG. 8 is a side section of the blade taken along the line 8—8 in FIG. 7.

With reference to FIGS. 7 and 8, the flat elongated blade 20 has a lengthwise slot 26 for engaging the flattened end of a collapsible tube. Teeth 46 in slot 26 prevent the tube end from slipping out of the slot. Blade 20 also has an integrally molded ring or second cylinder 44, another of the pivot elements, at one end of the blade. Second cylinder 44 extends through both top and bottom surfaces 43 and 45 respectively of blade 20 by approximately equal amounts. Thus, when blade 20 is connected to a clip, blade 20 is about equidistant from both arms of that clip.

The dimensions of first and second cylinders 36 and 44 respectively in FIGS. 5 through 8 are such as to enable second cylinder 44 on blade 20 fit over first cylinder 36 of clip 22 and thereby connect blade 20 to clip 22. Second cylinder 44 has an interior diameter, typically about 0.290 inches (7.37 mm), which is equal to or more usually slightly larger than the exterior diameter of first cylinder 36, typically about 0.270 inches (6.86 mm). Annular boss 42 on first cylinder 36 increases the effective diameter of first cylinder 36, typically to about 0.295 inches (7.49 mm). Because the molded clip material is tough but flexible, the boss yields slightly to enable second cylinder 44 to fit snugly around first cylinder 36, but not so tightly as to prevent smooth operation of the pivot.

Assembly of the tube folding article described above is simple. Blade 20 is connected to clip 22 by fitting second cylinder 44 around first cylinder 36. Then the two arms 28 and 30 are pressed together to insert rod 34 into first cylinder 36. The pivot elements 34, 36 and 44 are securely held together with the aid of head 38, retainer 40 and boss 42 to produce a very durable and easy-to-use tube folding article.

I claim:

1. A two-piece winding key for dispensing material from a collapsible tube comprising, a flat, narrow blade member defining a lengthwise slot of a dimension to receive the collapsed portion of a collapsible tube to be folded around said blade as material is dispensed therefrom; and a U-shaped unitary clip having a pair of flat arm members parallel to, and on opposite sides of, said blade, said blade and said clip each having coaxial pivot members integral with the blade and clip, said pivot members including a rod and a first hollow cylinder, each projecting toward the other from one of said arms, the rod frictionally engaging the interior of the cylinder, and a second hollow cylinder formed in an end of the blade, said second hollow cylinder coaxially disposed in contact with the outside periphery of the first cylinder, with said blade pivoting between said flat arm members.

2. A two-piece winding key for collapsible tubes comprising an elongated blade having a lengthwise slot formed therein for engaging the collapsed portion of a collapsible tube, a unitary clip pivotally connected to said blade, near an end thereof, said clip being U-shaped with first and second arms forming a bend at one end of said arms, and a pivot connecting said blade and said clip, the pivot having first and second cylinders, each having interior and exterior diameters, and a rod, said rod extending from an end of said first arm toward said second arm, said first cylinder extending from an end of said second arm toward said first arm, said second cylinder formed at an end of said blade, the interior diameter of said first cylinder frictionally engaging said rod and the interior diameter of the second cylinder approximately equal to said exterior diameter of said first cylinder and in coaxial relation therewith for pivotally fitting over said first cylinder, thereby enabling the blade to pivot between said arms.

3. The article of claim 2 wherein said rod has a rod diameter and terminates in a head, said head having a maximum head diameter larger than said rod diameter, said interior diameter of said first cylinder being approximately equal to said maximum head diameter.

4. The article of claim 3 wherein said first cylinder terminates in an annular retainer having an internal diameter approximately equal to said rod diameter, said retainer being integrally formed on said first cylinder.

5. The article of claim 2 wherein said first cylinder has an annular boss around an outside surface thereof.

6. A two-piece winding key for folding a collapsible tube comprising, an elongated blade having a lengthwise slot formed therein, said slot having a plurality of teeth for gripping a collapsed end of a collapsible tube, a unitary clip pivotally engaging said blade, said clip being U-shaped with first and second arms integrally united at a bend at one end of said arms, and a pivot connecting said blade and said clip, the pivot having first and second cylinders each having interior and exterior diameters and a rod, said first cylinder extending from an end of said second arm toward said first arm, said first cylinder terminating in an annular retainer integrally formed on said first cylinder, said rod integral with and extending from an end of said first arm toward said second arm and terminating in a head, said rod having a rod diameter, said head having a maximum head diameter larger than said rod diameter, said second cylinder formed through an end of said blade, said interior diameter of said first cylinder being approximately equal to said maximum head diameter for receiving said rod, said annular retainer having an interior diameter approximately equal to said rod diameter, said first cylinder having an exterior diameter and an annular boss around an outside surface thereof, said second cylinder having an interior diameter approximately equal to said exterior diameter of said first cylinder for pivotally fitting said second cylinder over said first cylinder.

* * * * *